US011454056B2

(12) United States Patent
Paré

(10) Patent No.: US 11,454,056 B2
(45) Date of Patent: Sep. 27, 2022

(54) LOCKING ASSEMBLY FOR A DISPENSER AND DISPENSER

(71) Applicant: Cascades Canada ULC, Kingsey Falls (CA)

(72) Inventor: Richard Paré, Boucherville (CA)

(73) Assignee: CASCADES CANADA ULC, Kingsey Falls (CA)

( * ) Notice: Subject to any disclaimer, the term of this patent is extended or adjusted under 35 U.S.C. 154(b) by 771 days.

(21) Appl. No.: 16/397,215

(22) Filed: Apr. 29, 2019

(65) Prior Publication Data

US 2019/0330891 A1 Oct. 31, 2019

Related U.S. Application Data

(60) Provisional application No. 62/663,330, filed on Apr. 27, 2018.

(51) Int. Cl.
*E05C 19/06* (2006.01)
*A47K 10/32* (2006.01)

(52) U.S. Cl.
CPC ..... *E05C 19/06* (2013.01); *A47K 10/32* (2013.01); *A47K 2010/3246* (2013.01)

(58) Field of Classification Search
CPC .. E05C 19/06; A47K 10/32; A47K 2010/3246
(Continued)

(56) References Cited

U.S. PATENT DOCUMENTS 2,720,773 A 10/1955 Gehrie
3,402,578 A 9/1968 Atkinson
(Continued)

FOREIGN PATENT DOCUMENTS

CA 2835750 C * 7/2019 ..... A47K 10/36
EP 2283194 B1 * 2/2016 ..... A47K 10/32
(Continued)

OTHER PUBLICATIONS

Lavex, Plastic Key for Lavex Janitorial Circular Toilet Tissue Dispenser, Website : https://www.webstaurantstore.com/plastic-key-for-lavex-janitorial-circular-toilet-tissue-dispenser/274JTKEY.html, Webstaurantstore, Item #: 274JTKEY, Retreived on Dec. 2, 2018, p. 1 : Details: This plastic key is designed specifically for use with your Lavex Janitorial 9 single roll toilet tissue dispenser.
(Continued)

*Primary Examiner* — Stephen M Gravini
(74) *Attorney, Agent, or Firm* — Marshall, Gerstein & Borun LLP

(57) ABSTRACT

There is provided a locking assembly mountable to a dispenser having a base part and a cover movable relative to each other between a closed configuration and an open configuration. The locking assembly is configured to lock the base part and the cover in the closed configuration when mounted to the dispenser and comprises an unlocking component mountable to one of the base part and the cover and having an unlocking body translatable to configure the locking assembly into an unlocked configuration; and a pushbutton at least partially contained in the unlocking body. The locking assembly is selectively configurable into a key-opening configuration wherein the pushbutton is prevented from translation and in a pushbutton-opening configuration wherein pressure on the pushbutton engages the unlocking body into translation to configure the locking assembly into the unlocked configuration.

25 Claims, 11 Drawing Sheets

(58) Field of Classification Search
USPC ..... 70/162
See application file for complete search history.

(56) References Cited

U.S. PATENT DOCUMENTS

| | | | | |
|---|---|---|---|---|
| 3,500,667 | A | 3/1970 | Jespersen | |
| 3,919,866 | A | 11/1975 | Lipschutz | |
| 4,306,431 | A | 12/1981 | Craig | |
| 4,662,664 | A | 5/1987 | Wendt et al. | |
| 5,259,221 | A | 11/1993 | Whitmore | |
| 6,006,558 | A | 12/1999 | Peters | |
| 6,454,320 | B1 | 9/2002 | Weinerman et al. | |
| 6,564,602 | B2 | 5/2003 | Gregory | |
| 6,755,449 | B2 | 6/2004 | Weinerman et al. | |
| 6,872,905 | B2 | 3/2005 | Kuepper et al. | |
| 6,964,184 | B1 | 11/2005 | Gregory | |
| 7,240,523 | B2 | 7/2007 | Johansson et al. | |
| 7,654,417 | B2 * | 2/2010 | Rhodenbaugh | A47K 5/12 222/153.09 |
| 7,984,829 | B2 * | 7/2011 | Cittadino | A47K 5/12 222/153.09 |
| 7,997,522 | B2 | 8/2011 | Titas et al. | |
| 8,561,441 | B2 | 10/2013 | Herrmann et al. | |
| 8,561,847 | B2 * | 10/2013 | Rosenkranz | A47K 5/12 222/153.09 |
| 9,260,883 | B2 | 2/2016 | Raty et al. | |
| 9,279,273 | B2 | 3/2016 | Eriksson et al. | |
| 9,878,869 | B2 * | 1/2018 | Morand | B65H 35/0086 |
| 11,160,423 | B2 * | 11/2021 | Marshall | A47K 5/1207 |
| 2007/0029340 | A1 * | 2/2007 | Nagelski | A47F 1/10 221/268 |
| 2019/0000172 | A1 * | 1/2019 | Sahley | G07F 9/105 |
| 2019/0330891 | A1 * | 10/2019 | Paré | E05C 19/06 |
| 2020/0122946 | A1 * | 4/2020 | Paré | B65H 19/10 |
| 2020/0245823 | A1 * | 8/2020 | Rozek | E05C 19/06 |

FOREIGN PATENT DOCUMENTS

| | | | | |
|---|---|---|---|---|
| WO | WO-2009123509 | A1 * | 10/2009 | A47K 10/32 |
| WO | WO-2013044385 | A1 * | 4/2013 | A47K 10/36 |

OTHER PUBLICATIONS

GeorgiaPacific, Georgia Pacific 504Set Keys, Commercial-Grade Complete Set of Dispenser Keys for Georgia Pacific, Website: https://www.amazon.com/Georgia-Pacific-Commercial-Grade-Complete-Dispenser/dp/B00DDULF58, Retreived on Dec. 2, 2018, p. 5 : Product description: this set of keys will open any Georgia Pacific towel or tissue cabinet or dispenser.

* cited by examiner

LOCKING ASSEMBLY FOR A DISPENSER AND DISPENSER

CROSS-REFERENCE TO RELATED APPLICATIONS

The present application claims priority from U.S. provisional patent application No. 62/663,330, filed on Apr. 27, 2018, and entitled "LOCKING ASSEMBLY FOR A DISPENSER AND DISPENSER", the disclosure of which being hereby incorporated by reference in its entirety.

TECHNICAL FIELD

The present disclosure generally relates to locking assemblies to lock together two elements. More particularly, the present disclosure relates to a locking assembly configured to lock together a base part and a cover of a dispenser, the base part and the cover defining together a dispensing chamber, to contain, for instance, a web material roll. The present disclosure further relates to a dispenser including the locking assembly.

BACKGROUND

Several types of web material roll dispensers exist to gradually provide a user of the web material roll dispenser with different types of web material. The most common types of dispensers dispense paper items such as paper towels and toilet paper.

In the dispenser field, locking assemblies are used to lock a base part and a cover together in a closed configuration. Several types of locking assemblies exist which include a key enabling the configuration of the locking assembly into an unlocked configuration, so as to provide access to a dispensing chamber of the dispenser, for instance to fill it with web material to be dispensed. However, the key might be lost or damaged, such an event jeopardizing the possibility of configuring the dispenser in the open configuration, and thus jeopardizing the use of the dispenser. Some other known locking assemblies comprise a pushbutton onto which pressure must be applied to configure the locking assembly into the unlocked configuration. However, it is not fully satisfactory since these dispensers are often used in public area, such as washrooms, and thus an ill-intentioned person could unlock the locking assembly, for instance to remove the web material out of the dispensing chamber.

In view of the above, there is a need for an improved dispenser comprising a locking assembly which would be able to overcome or at least minimize some of the above-discussed prior art concerns.

BRIEF SUMMARY

It is therefore an aim of the present invention to address the above-mentioned issues.

According to a general aspect, there is provided locking assembly mountable to a dispenser having a base part and a cover movable relative to each other between a closed configuration and an open configuration, the locking assembly being configured to lock the base part and the cover in the closed configuration when mounted to the dispenser, the locking assembly comprising an unlocking component mountable to one of the base part and the cover and comprising: an unlocking body translatable to configure the locking assembly into an unlocked configuration; and a pushbutton at least partially contained in the unlocking body.

The locking assembly is selectively configurable into a key-opening configuration wherein the pushbutton is prevented from translation and in a pushbutton-opening configuration wherein pressure on the pushbutton engages the unlocking body into translation to configure the locking assembly into the unlocked configuration.

According to another general aspect, there is provided a web material dispenser comprising: a housing defining a dispensing chamber and having a base part and a cover movable relative to each other between a closed configuration in which said dispensing chamber is at least partially closed, and an open configuration for providing access to said dispensing chamber; and a locking assembly according to the present disclosure to lock the base part and the cover in the closed configuration, the unlocking component being mounted to one of the base part and the cover.

According to another general aspect, there is provided dispenser comprising: a housing defining a dispensing chamber and having a base part and a cover movable relative to each other between a closed configuration in which said dispensing chamber is at least partially closed, and an open configuration for providing access to said dispensing chamber; and a locking assembly mounted to one of the base part and the cover to lock the base part and the cover in the closed configuration, the locking assembly comprising an unlocking component including: an unlocking body translatable to configure the locking assembly into an unlocked configuration, and a pushbutton at least partially contained in the unlocking body. The locking assembly is selectively configurable in a key-opening configuration wherein the pushbutton is prevented from translation and in a pushbutton-opening configuration wherein pressure on the pushbutton engages the unlocking body into translation to configure the locking assembly into the unlocked configuration.

According to another general aspect, there is provided a dispenser comprising a housing. The housing defines a dispensing chamber and has a base part and a cover movable between a closed configuration in which the dispensing chamber is at least partially closed, and an open configuration for providing access to the dispensing chamber. The dispenser further comprises a locking assembly to lock the base part and the cover in the closed configuration. The locking assembly comprises an unlocking component including an unlocking body translatable to configure the locking assembly into an unlocked configuration, and a pushbutton at least partially contained in the unlocking body. The locking assembly is selectively configurable in a key-opening configuration wherein the pushbutton is prevented from translation and in a pushbutton-opening configuration wherein pressure on the pushbutton engages the unlocking body into translation to configure the locking assembly into the unlocked configuration.

According to another aspect, there is provided a dispenser comprising a housing. The housing defines a dispensing chamber and has a base part and a cover movable between a closed configuration in which the dispensing chamber is at least partially closed, and an open configuration for providing access to the dispensing chamber. The dispenser further comprises a locking assembly to lock the base part and the cover together in the closed configuration. The locking assembly comprises a catch-engaging portion mounted to one of the base part and the cover, a lock catch mounted to the other one of the base part and the cover pivotable about a pivoting axis and engageable with the catch-engaging portion to maintain the base part and the cover in the closed configuration, and an unlocking component. The unlocking component comprises an unlocking body translatable along an unlocking axis extending substantially parallel to the pivoting axis and configured to contact the lock catch along the unlocking axis to pivot same into a disengaged configuration. The unlocking component further comprises a pushbutton at least partially contained in the unlocking body. The locking assembly is selectively configurable in a key-opening configuration wherein the pushbutton is prevented from translation along the unlocking axis and in a pushbutton-opening configuration wherein pressure on the pushbutton engages the unlocking body into translation to configure the locking assembly into the unlocked configuration.

In an embodiment, the locking assembly further comprises: a catch-engaging portion mountable to the other one of the base part and the cover; and a lock catch mountable to the one of the base part and the cover, the lock catch being configurable between an engaged configuration wherein the lock catch is engaged with the catch-engaging portion to maintain the base part and the cover in the closed configuration when the locking assembly is mounted to the dispenser, and a disengaged configuration wherein the lock catch is disengaged from the catch-engaging portion for the base part and the cover to be configurable in the open configuration when the locking assembly is mounted to the dispenser. The lock catch can be configured into the disengaged configuration when the locking assembly is configured into the unlocked configuration. The lock catch can be pivotably mountable to the one of the base part and the cover about a pivoting axis. The unlocking body can be translatable along an unlocking axis extending substantially parallel to the pivoting axis. The unlocking body can comprise a peripheral wall having a tapered shape and engaging with the lock catch when the unlocking body is translated along the unlocking axis. The unlocking body can comprise an actuation end and an opposed unlocking end cooperating with the lock catch when the unlocking body is translated along the unlocking axis, the peripheral wall of the unlocking body being tapered towards the unlocking end. A through opening can be formed in the unlocking body, the pushbutton being at least partially slidably received in the through opening. The pushbutton can comprise a head protruding externally from the actuation end of the unlocking body, the actuation end of the unlocking body having an outer surface including a central portion covered by the head of the pushbutton and an exposed portion, surrounding the central portion. The exposed portion of the actuation end of the unlocking body can be substantially annular in shape.

In an embodiment, the locking assembly further comprises: a biasing member operatively engaged with the lock catch and exerting a biasing force thereto to bias the lock catch into the engaged configuration.

In an embodiment, the lock catch comprises an arm having a first end pivotally mountable to the one of the base part and the cover, and a second end comprising a hook engageable with the catch-engaging portion.

In an embodiment, the lock catch comprises first and second catch portions defining a gap therebetween, the unlocking body being translatable into the gap. The first and second catch portions can be pivotably mountable to the one of the base part and the cover about substantially parallel first and second pivoting axes.

In an embodiment, the locking assembly further comprises: a locking casing mountable to the one of the base part and the cover and defining an interior volume containing at least partially the unlocking component.

In an embodiment, the locking assembly further comprises: a function switch movable between a pushbutton-blocking configuration in which the function switch prevents the pushbutton from being translated, and a pushbutton displacement configuration in which the pushbutton is translatable. The function switch can comprise a pushbutton abutment, the pushbutton abutting against the pushbutton abutment when the function switch is configured in the pushbutton-blocking configuration. The unlocking body can comprise an actuation end and an opposed unlocking end, wherein the pushbutton abutment circumvents the unlocking end of the unlocking body, when the function switch is configured in the pushbutton-blocking configuration. The unlocking body can be translatable along an unlocking axis, wherein the function switch is slidably mountable to the one of the base part and the cover along a first direction substantially perpendicular to the unlocking axis.

In an embodiment, the locking assembly further comprises: a key having a distal end with a peripheral wall defining a recess to receive a portion of the pushbutton when the peripheral wall is at least partially inserted into the peripheral groove. In an embodiment, the distal end of the peripheral wall of the key contacts the exposed portion of the outer surface of the unlocking body when engaged in the peripheral groove.

In an embodiment, the function switch is accessible only when the cover and the base part are in the open configuration.

DETAILED DESCRIPTION

In the following description, the same numerical references refer to similar elements. Furthermore, for the sake of simplicity and clarity, namely so as to not unduly burden the figures with several reference numbers, not all figures contain references to all the components and features, references to some components and features may be found in only one figure, and components and features of the present disclosure which are illustrated in other figures can be easily inferred therefrom. The embodiments, geometrical configurations, materials mentioned and/or dimensions shown in the figures are optional and are given for exemplification purposes only.

Moreover, it will be appreciated that positional descriptions such as "above", "below", "forward", "rearward" "left", "right" and the like should, unless otherwise indicated, be taken in the context of the figures and correspond to the position and orientation of the dispenser and corresponding parts when being secured to a wall, with the "front" corresponding to a position closer to the user of the dispenser and the "rear" corresponding to a position closer to the wall to which the dispenser is secured. Positional descriptions should not be considered limiting.

Although various features may be described in the context of a single embodiment, the features may also be provided separately or in any suitable combination. Conversely, although the invention may be described herein in the context of separate embodiments for clarity, it may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments.

It is to be understood that the phraseology and terminology employed herein is not to be construed as limiting and are for descriptive purpose only.

It is to be understood that the terms "including", "comprising", and grammatical variants thereof do not preclude the addition of one or more components, features, steps, or integers or groups thereof and that the terms are to be construed as specifying components, features, steps or integers.

If the specification or claims refer to "an additional" element, this does not preclude there being more than one of the additional element. It is to be understood that, where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

General Structure of the Dispenser

Figure 1:
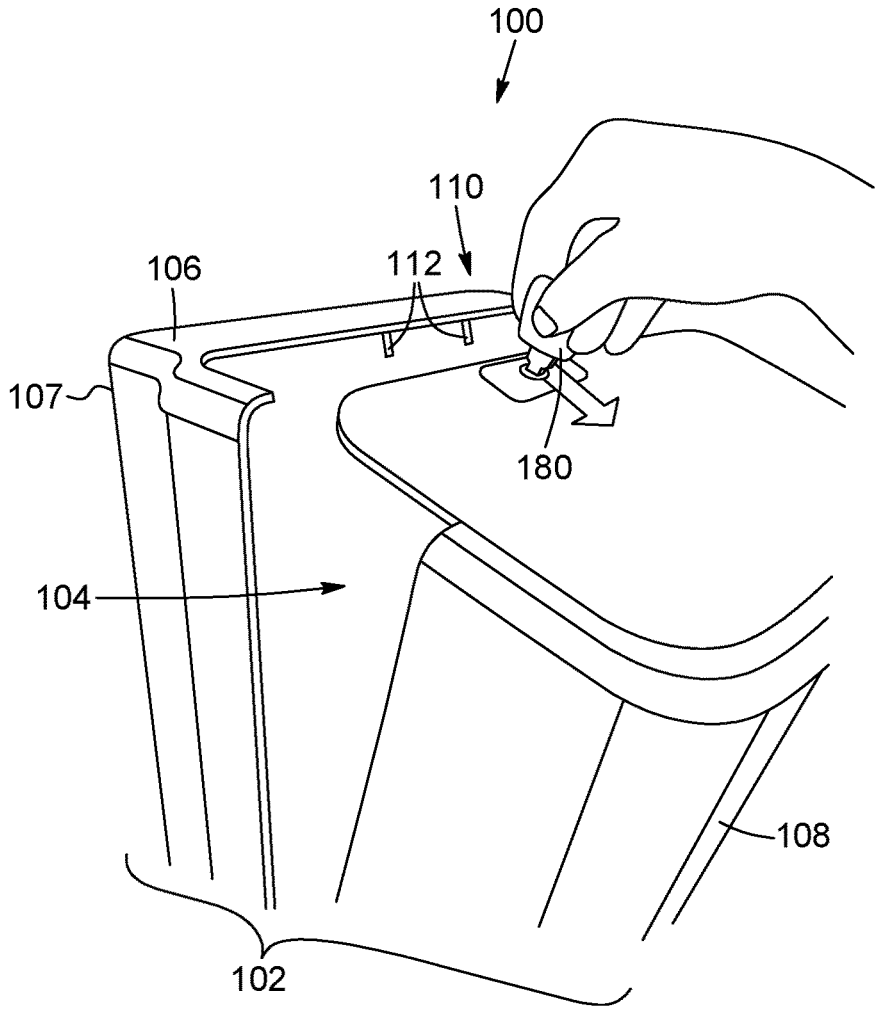
FIG. 1 is a perspective view of an upper portion of a dispenser including a cover hingedly mounted to a base part according to the present disclosure, wherein the base part and the cover are configured in a partially open configuration.
Figure 2:
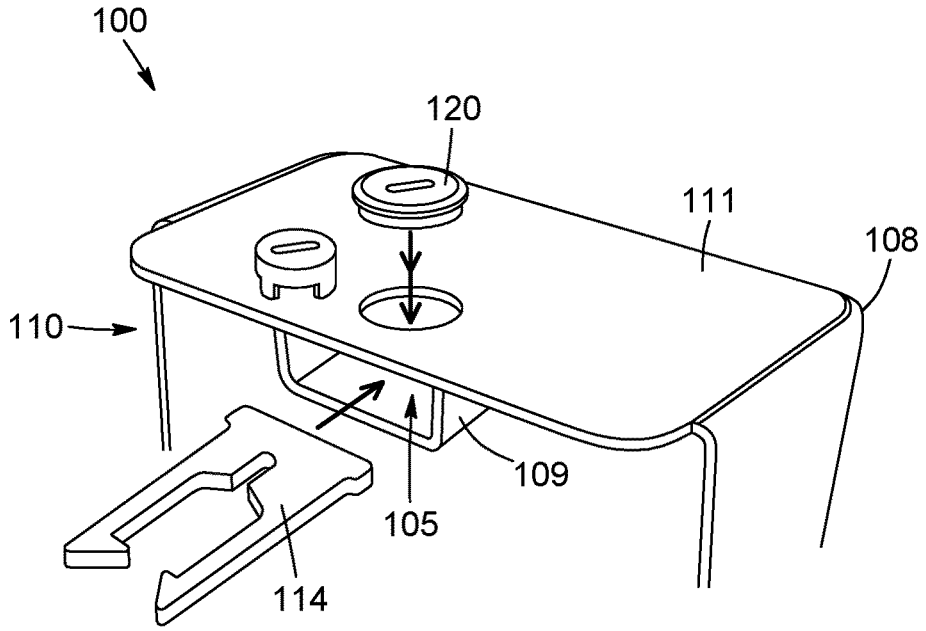
FIG. 2 is a top perspective view, partially exploded, of an upper portion of the cover of the dispenser of FIG. 1.
Figure 3:
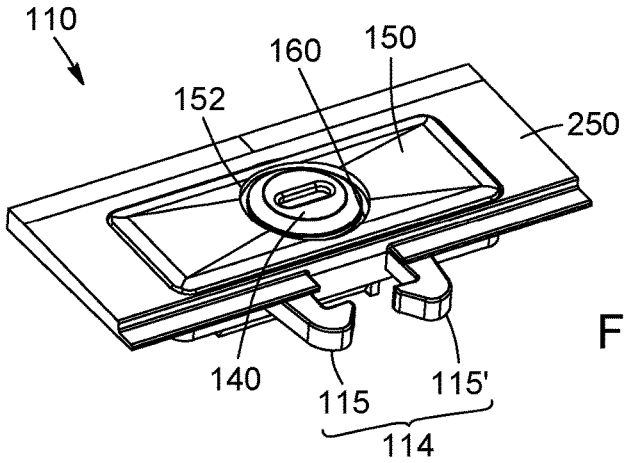
FIG. 3 is a top perspective view of a first embodiment of a locking assembly according to the present disclosure.

Referring now to the drawings, and more particularly to FIGS. 1 and 2, there is shown a dispenser 100 comprising a housing 102 defining a dispensing chamber 104.

The housing 102 comprises a base part 106 and a cover 108. The cover 108 and the base part 106 are movable relative to each other. The base part 106 has a rear portion 107 that is configured to be mounted to a supporting surface, for instance, a wall. In the embodiment shown, the cover 108 is pivotally mounted to the base part 106, in the lower portion thereof. Therefore, the cover 108 and the base part 106 are movable relative to each other between a closed configuration, in which the dispensing chamber 104 is at least partially closed, and an open configuration, as shown in FIG. 1, in which access is provided to the dispensing chamber 104. It is appreciated that the shape and the configuration of the base part 106 and the cover 108 could vary from the embodiment shown. The cover 108 could for instance and without being limitative be pivotable about a substantially vertical axis and be pivotally mounted to a lateral portion of the base part 106.

The dispenser 100 further comprises a locking assembly 110, which can be selectively and alternatively configured in a locked configuration, in which the cover 108 and the base part 106 are locked together in the closed configuration, and an unlocked configuration in which the cover 108 and the base part 106 are free from being moved relative to each other (for instance, in which the cover 108 is free from being pivoted away from the base part 106) so that the base part 106 and the cover 108 can be configured in the open configuration.

As will further be described in more details, the lock assembly 110 comprises a catch-engaging portion 112 mounted, in the shown embodiment, to the base part 106 of the dispenser 100, and a lock catch 114 mounted, in the shown embodiment, to the cover 108. The lock catch 114 is engageable with the catch-engaging portion 112 to maintain the base part 106 and the cover 108 in the closed configuration. In other words, the lock catch 114 is displaceable between an engaged configuration in which the lock catch 114 is engaged with the catch-engaging portion 112 to maintain the base part 106 and the cover 108 in the closed configuration, and a disengaged configuration in which the lock catch 114 is disengaged from the catch-engaging portion 112 for the base part 106 and the cover 108 to be displaceable relative to each other to be configurable into the open configuration. It is appreciated that, in an alternative embodiment (not shown), the base part 106 can include the lock catch 114 while the cover 108 includes the catch-engaging portion 112.

As shown in FIG. 2, the cover 108 of the dispenser 100 comprises a locking casing 109. In the embodiment shown, the locking casing 109 is located in the dispensing chamber 104 of the housing 102 and protrudes inwardly from an inner surface of an upper wall 111 of the cover 108. With the upper wall or a portion of the locking assembly 110, the locking (or inner) casing 109 delimits an interior volume 105 that is dimensioned and shaped to receive at least some components of the locking assembly 110. In the embodiment shown in which the lock catch 114 is mounted to the cover 108, the inner casing 109 is configured (i.e. is dimensioned and shaped) to receive at least a portion of the lock catch 114.

Moreover, as shown in FIGS. 3 to 16, the locking assembly 110 further comprises an unlocking component 120 having an unlocking body 130 displaceable (translatable in the embodiment shown) to configure the locking assembly 110 into the unlocked configuration.

The unlocking component 120 further comprises a pushbutton 140 at least partially contained in the unlocking body 130.

Figure 18:
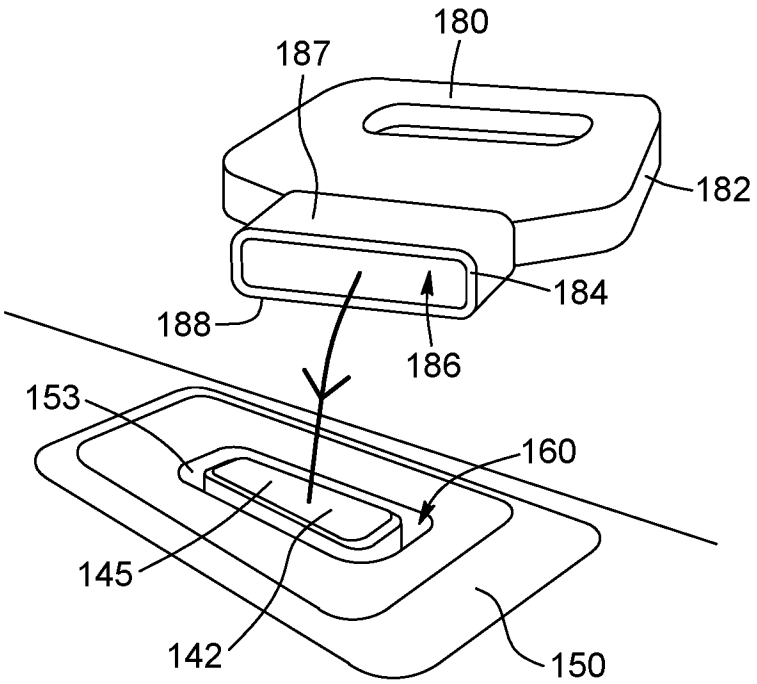
FIGS. 17 and 18 are top perspective views of first and second embodiments of keys configured to cooperate with locking assemblies according to the present disclosure.
Figure 17:
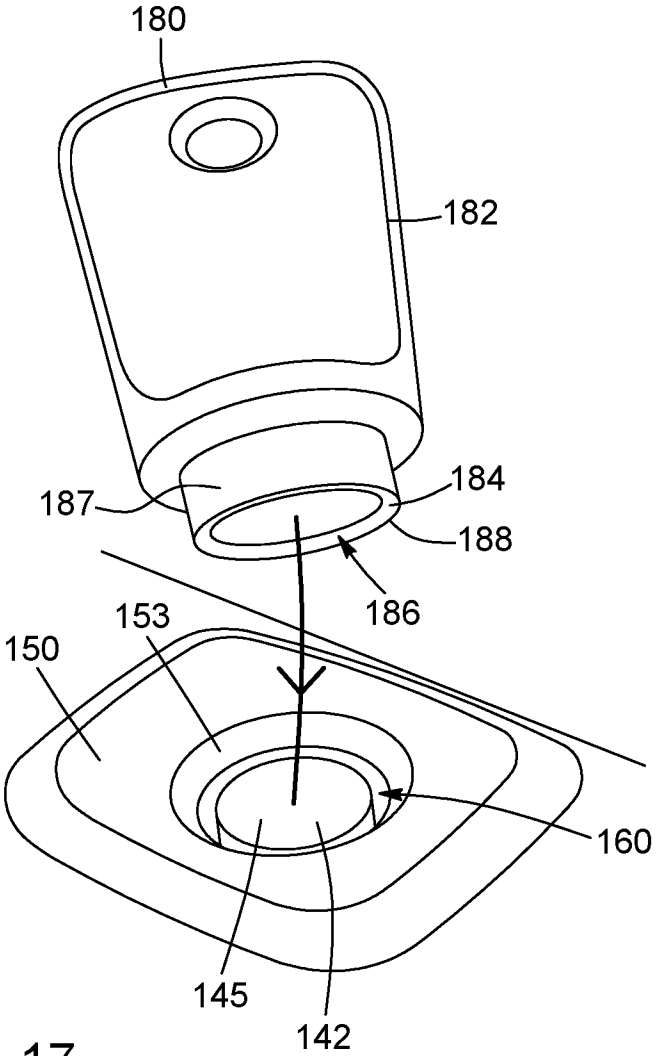

The locking assembly 110 is selectively configurable in a key-opening configuration wherein the pushbutton 140 is prevented from translation in the interior volume 105 of the inner casing 109 (or with respect to the housing 102) and wherein pressure should be applied directly onto the unlocking body 130 to engage the unlocking body 130 into translation in the interior volume 105 of the inner casing 109. When the locking assembly 110 is configured in the key-opening configuration, a key 180 as shown in FIGS. 17 and 18 is needed to translate the unlocking body 130 in the inner casing 109. The locking assembly 110 is further selectively configurable in a pushbutton-opening configuration wherein pressure applied on the pushbutton 140 engages the unlocking body 130 into translation in the inner casing 109 to configure the locking assembly 110 into the unlocked configuration.

In other words, the locking assembly 110 is configured so that, when it is configured in the key-opening configuration, the key 180 is required to configure the locking assembly 110 in the unlocked configuration, whereas when the locking assembly 110 is configured in the pushbutton-opening configuration, no key is required to configure the locking assembly 110 into the unlocked configuration. A pressure applied on the pushbutton 140 of the unlocking component 120 is sufficient for the locking assembly 110 to be configured in the unlocked configuration.

In the following description, the terms "inner" and "outer" should be understood, unless otherwise stated, with regards to the interior volume 105 of the inner (or locking) casing 109 in which at least some of the components of the locking assembly 110 are arranged or with regards to the dispensing chamber 104 of the housing 102. In other words, the term "outer" should be understood, unless otherwise stated, as being relative to a volume outside the interior volume 105 of the locking casing 109 or as being exposed outwardly of the interior volume of the locking casing 109 (or with regards to the dispensing chamber 104 of the housing 102).

First Embodiment of the Locking Assembly

Description of the Components

A first embodiment of the locking assembly 110 is shown in FIGS. 3 to 9.

Figure 8:
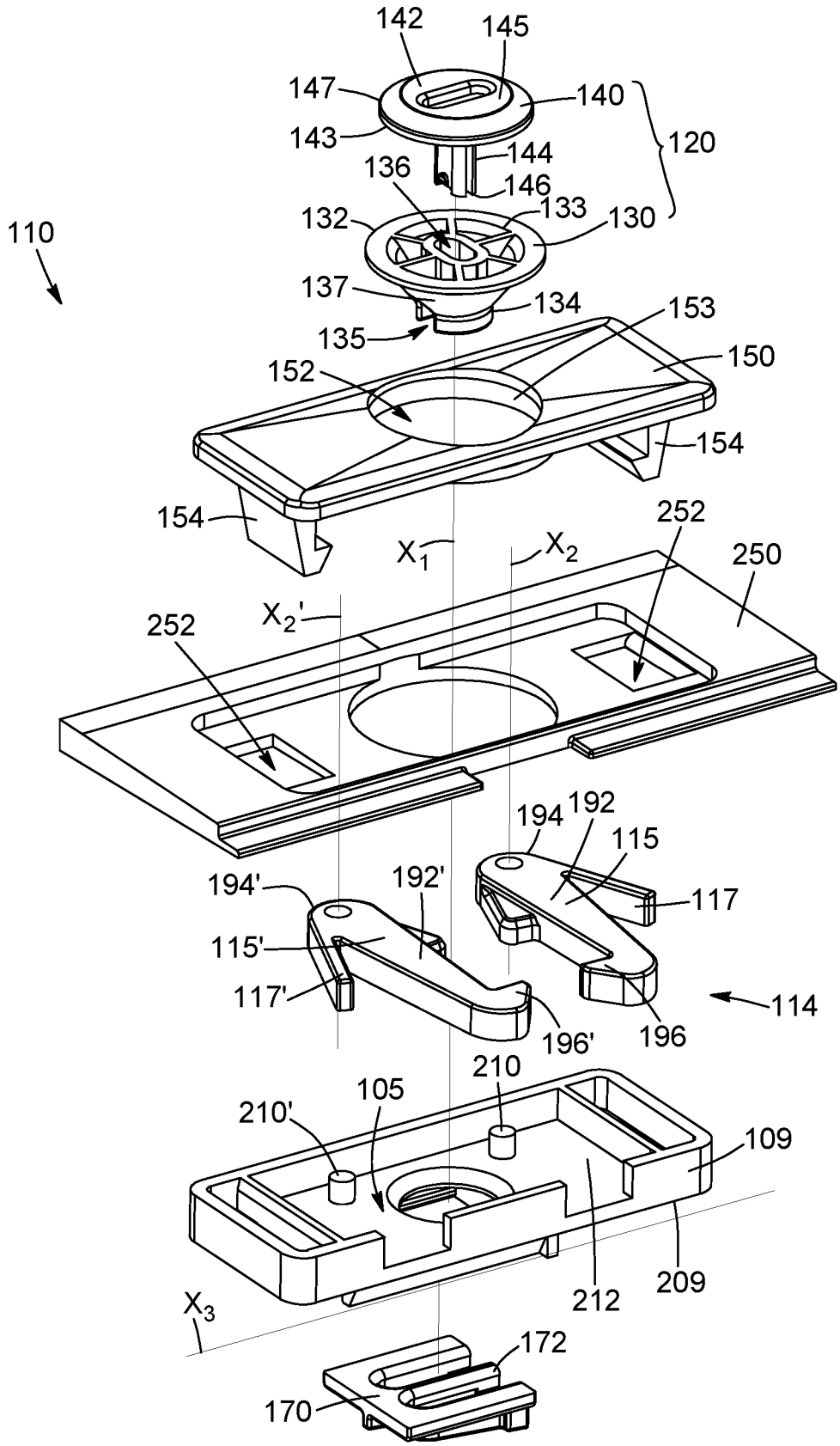
FIGS. 8 and 9 are top and bottom perspective views, exploded, of the locking assembly of FIG. 3.

In the shown embodiment, the unlocking body 130 has a substantially frusto-conical shape having an outer end 132 (or actuation end 132), in the shape of an exposed rim, and an opposed inner end 134 (or unlocking end 134). The substantially frusto-conical shape of the unlocking body 130 converges towards the unlocking end 134. In other words, the unlocking body 130 is tapered towards the unlocking end 134. The actuation end 132 comprises an outer surface 133 that is substantially circular, in the embodiment shown. A through opening 136 is formed in the unlocking body 130 that extends between the unlocking and actuation ends 134, 132. In the shown embodiment, as represented in FIG. 8, the through opening 136 has a substantially oval cross-section, but it could also be conceived a through opening having any other shape, such as a through opening 136 being substantially cylindrical.

The unlocking body 130 is translatable in the interior volume 105 of the inner casing 109 along an unlocking axis X1 and is configured to cooperate with the lock catch 114 along the unlocking axis X1. In the shown embodiment, the lock catch 114 is pivotably mounted to the cover 108 (to the inner casing 109 of the cover 108, in the embodiment shown, within the interior volume 105 thereof) about first and second pivoting axes X2, X2' that both extend substantially parallel to the unlocking axis X1, the unlocking body 130 being configured to contact the lock catch 114 when translating along the unlocking axis X1 to pivot the lock catch 114 about the pivoting axes X2, X2' into the disengaged configuration. When the lock catch 114 is configured into the disengaged configuration, the lock catch 114 is disengaged from the catch-engaging portion 112 and the cover 108 and the base part 106 can be displaced relatively to each other to be configurable from the closed configuration to the open configuration.

In the shown embodiment, the lock catch 114 comprises first and second catch portions 115, 115' that are both pivotally mounted in the inner casing 109 respectively about the first and second substantially parallel pivoting axes X2, X2'. The first and second catch portions 115, 115' are arranged so as to define a gap in-between, the inner end 134 (or unlocking end 134) of the unlocking body 130 of the unlocking component 120 being arranged in the gap defined between the first and second catch portions 115, 115'. It is appreciated that, in an alternative embodiment (not shown), the lock catch 114 can include only one catch portion.

Each one of the catch portions 115, 115' includes an arm 192, 192' pivotally mounted at a first end 194, 194' and including a hook 196, 196' at a second end. In the embodiment shown, the hooks 196, 196' of the two catch portions 115, 115' are oriented towards one another to engage the catch-engaging portion 112, which is located in-between in the closed configuration. In the embodiment shown, pins 210, 210' protrude from a bottom wall 212 of the inner casing 109, that are receivable in openings formed in the first ends 194, 194' of the catch portions 115, 115' to pivotally mount the first and second catch portions 115, 115' in the inner casing 109. It is appreciated that the shape and the configuration of the lock catch 114, as well as the shape, the configuration and the number of the catch portions 115, 115' can vary from the embodiment shown.

The locking assembly 110 further comprises first and second biasing members 117, 117', such as springs, that are arranged in the interior volume 105 of the inner casing 109 to cooperate respectively with the first and second catch portions 115, 115' and that are configured to exert a biasing force against the first and second catch portions 115, 115' to bias the first and second catch portions 115, 115' into the engaged configuration. The first and second biasing members 117, 117' are thus configured to bias the first and second catch portions 115, 115' towards the unlocking component 120, and more particularly towards the inner end 134 (or unlocking end 134) of the unlocking body 130, in the embodiment shown). In the embodiment shown, the first second biasing members 117, 117' are formed integral with the first and second catch portions 115, 115' and extend from the first and second ends 194, 194' thereof. It could also be conceived a locking assembly 110 comprising first and second biasing members 117, 117' that would be distinct from the first and second catch portions 115, 115'.

In the shown embodiment, the unlocking body 130 comprises a peripheral wall 137 extending between the actuation end 132 and the unlocking end 134 and having a tapered shape. The cross-section of the peripheral wall 137, considered in a plane substantially perpendicular to the unlocking axis X1, increases from the actuation end 132 towards the unlocking end 134.

The pushbutton 140 comprises a head 142, having a substantially circular shape; the head 142 has an inner face (or unlocking face) 143 and an outer face (or actuation face) 145. The pushbutton 140 further comprises a stem 144 extending substantially perpendicularly from the unlocking face 143 of the head 142, the stem 144 being dimensioned to be slidably received in the through opening 136 formed in the unlocking body 130. In the embodiment shown, as represented for instance in FIGS. 8 and 9, the stem 144 comprises two stem members spaced apart from each other at a lower portion thereof, but it could also be conceived a pushbutton 140 having a head 142 comprising a single stem member.

The stem 144 extends longitudinally along an axis that corresponds substantially to the unlocking axis X1 of the unlocking body 130.

The pushbutton 140 and the unlocking body 130 are dimensioned so that the outer surface 133 of the outer end 132 (or actuation end 132) of the unlocking body 130 is partially covered by the head 142 of the pushbutton 140 in a manner such that an exposed portion 235 of the outer surface 133 of the actuation end 132 of the unlocking body 130 is substantially annular in shape. In other words, the outer surface 133 of the actuation end 132 of the unlocking body 130 includes a central portion 233 covered by the head 142 of the pushbutton 140 (i.e. facing the inner face 143 of the head 142), and the exposed portion 235 (FIG. 6B). Moreover, the pushbutton 140 and the unlocking body 130 are shaped and dimensioned so that, when the stem 144 is engaged into the through opening 136, the inner face 143 (or unlocking face 143) of the head 140 abuts against the actuation end 132 of the unlocking body 130 and an inner end 146 of the stem 144 is substantially aligned, considered along the unlocking axis X1, with the unlocking end 134 (or inner end 134) of the unlocking body 130.

As shown in particular in FIG. 8, the locking assembly 110 further comprises a locking assembly cover 150 partially closing the inner casing 109 in which the unlocking component 120 and the lock catch 114 are at least partially contained. A substantially circular central opening 152 is formed in the locking assembly cover 150 to contain and expose the exposed portion 235 of the outer surface 133 of the actuation end 132 of the unlocking body 130 and the outer face 145 of the head 142 of the pushbutton 140. The exposed portion 235 of the outer surface 133 of the actuation end 132 of the unlocking body 130 surrounds the pushbutton 140. The exposed portion 235 of the outer surface 133 is recessed—considered along the unlocking axis X1—with respect to the outer face 145 of the pushbutton 140 in a manner such that an opened peripheral groove 160 is defined between an inner edge 153 delimiting the central opening 152 of the locking assembly cover 150 and a peripheral wall 147 of the head 142 of the pushbutton 140. A lower end of the opened peripheral groove 160 is delimited by the exposed portion 235 of the outer surface 133 of the actuation end 132 of the unlocking body 130 that is not covered by the head 142 of the pushbutton 140 and, thereby, accessible.

In the embodiment shown, the locking assembly 110 further comprises a locking hood 250 engageable with the locking assembly cover 150 (for instance via mounting arms 154 protruding from a lower surface of the locking assembly cover 150 receivable into mounting apertures 252 formed in the locking hood 250) to partially close the inner casing 109. It is appreciated that the shape and the configuration of the locking assembly cover 150 and the locking hood 250 can vary from the embodiment shown. It could also be conceived a locking assembly cover 150 that would be directly mountable to the inner casing 109.

Figure 9:
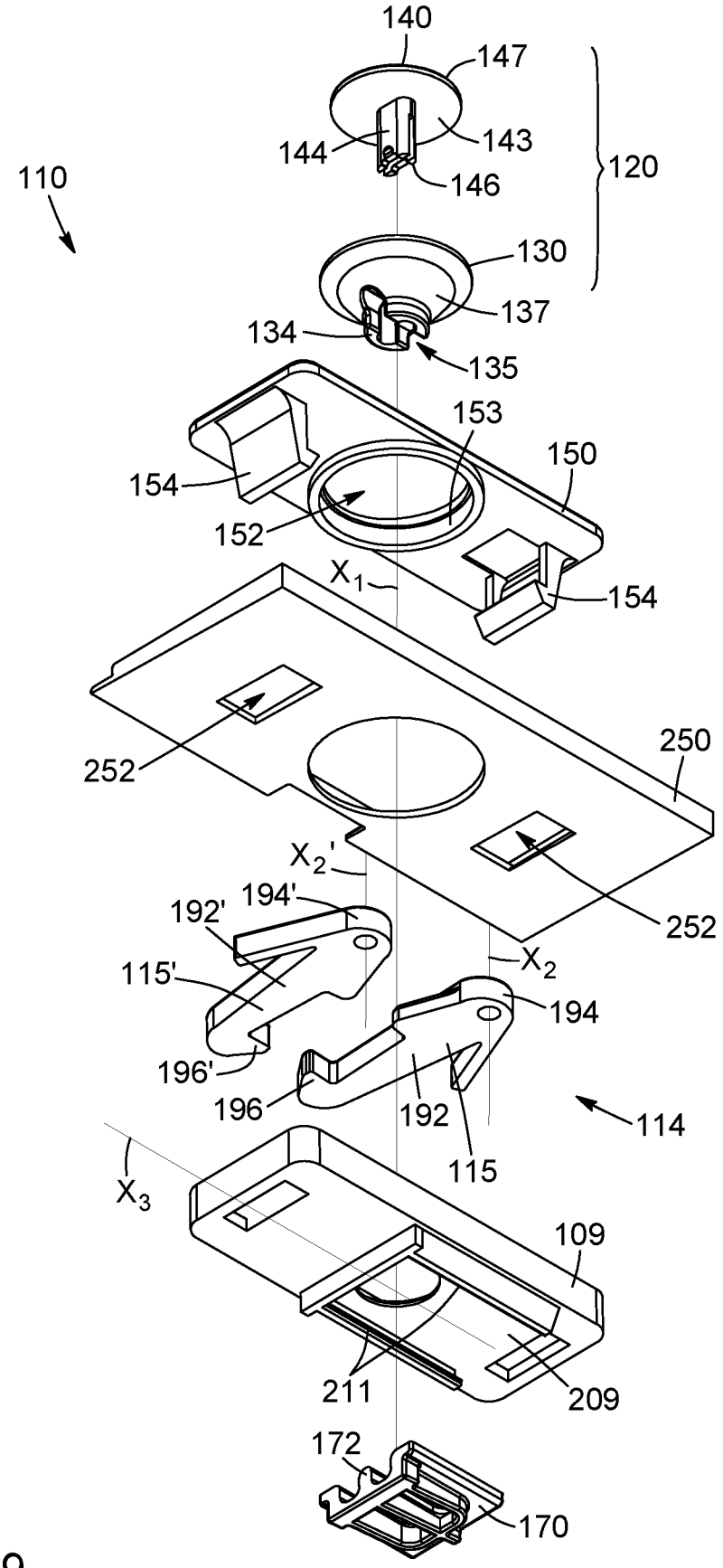
Figure 10:
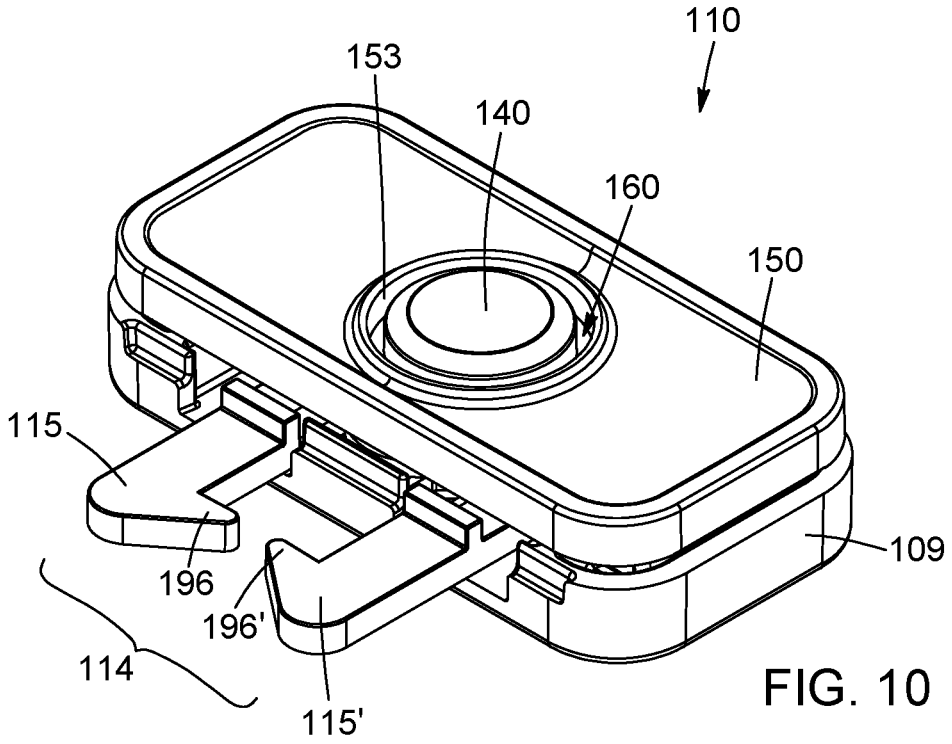
FIG. 10 is a top perspective view of a second embodiment of a locking assembly according to the present disclosure, the shape of the unlocking body differing from the one of the first embodiment.
Figure 11:
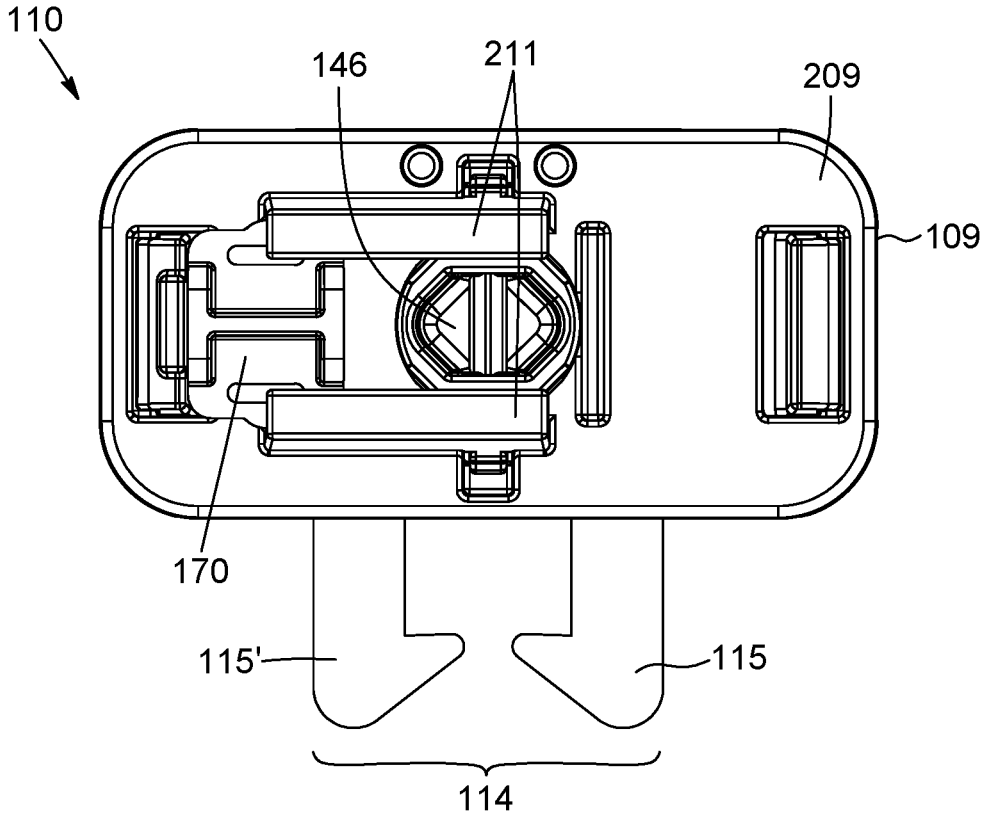
FIG. 11 is a bottom plan view of the locking assembly of FIG. 10.
Figure 12:
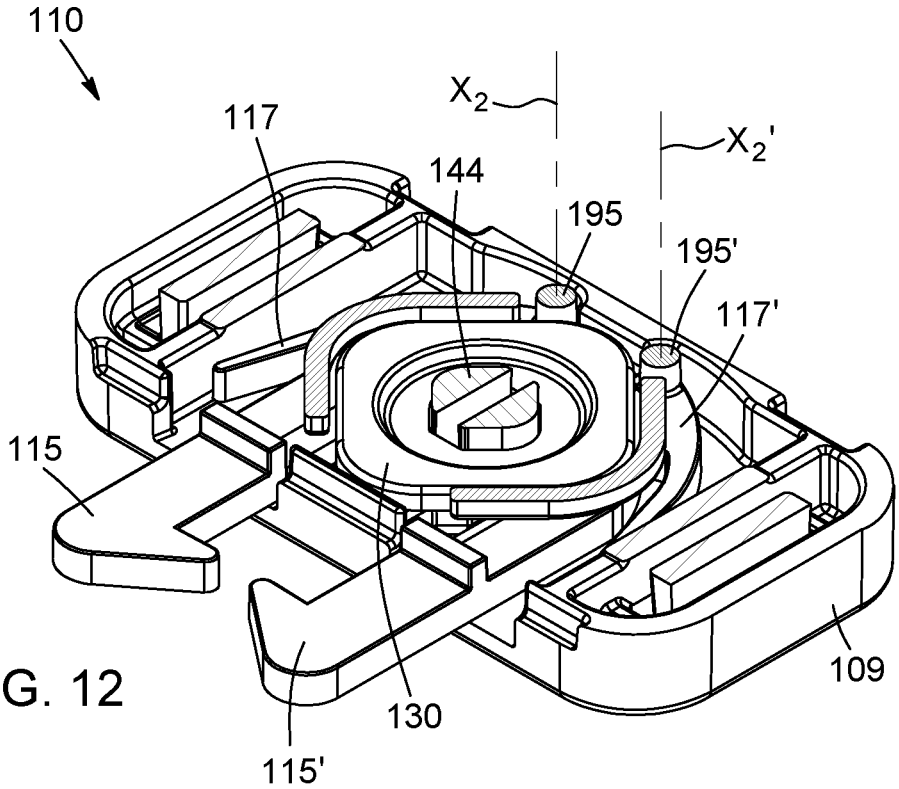
FIG. 12 is a top perspective view, sectioned, of the locking assembly of FIG. 10.
Figure 13:
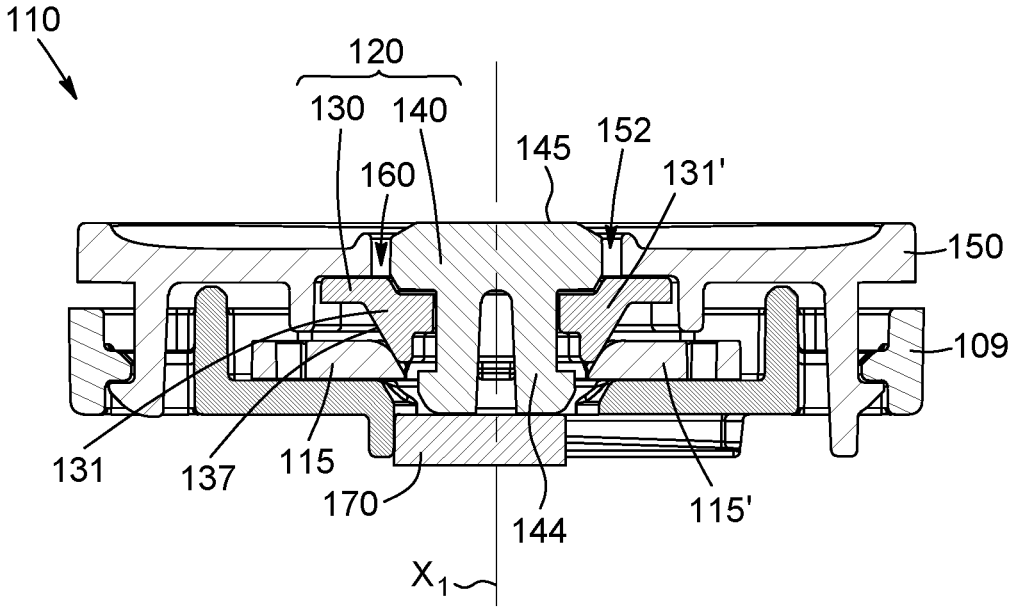
FIG. 13 is a cross-section view of the locking assembly of FIG. 10, the locking assembly being in the key-opening configuration.
Figure 14:
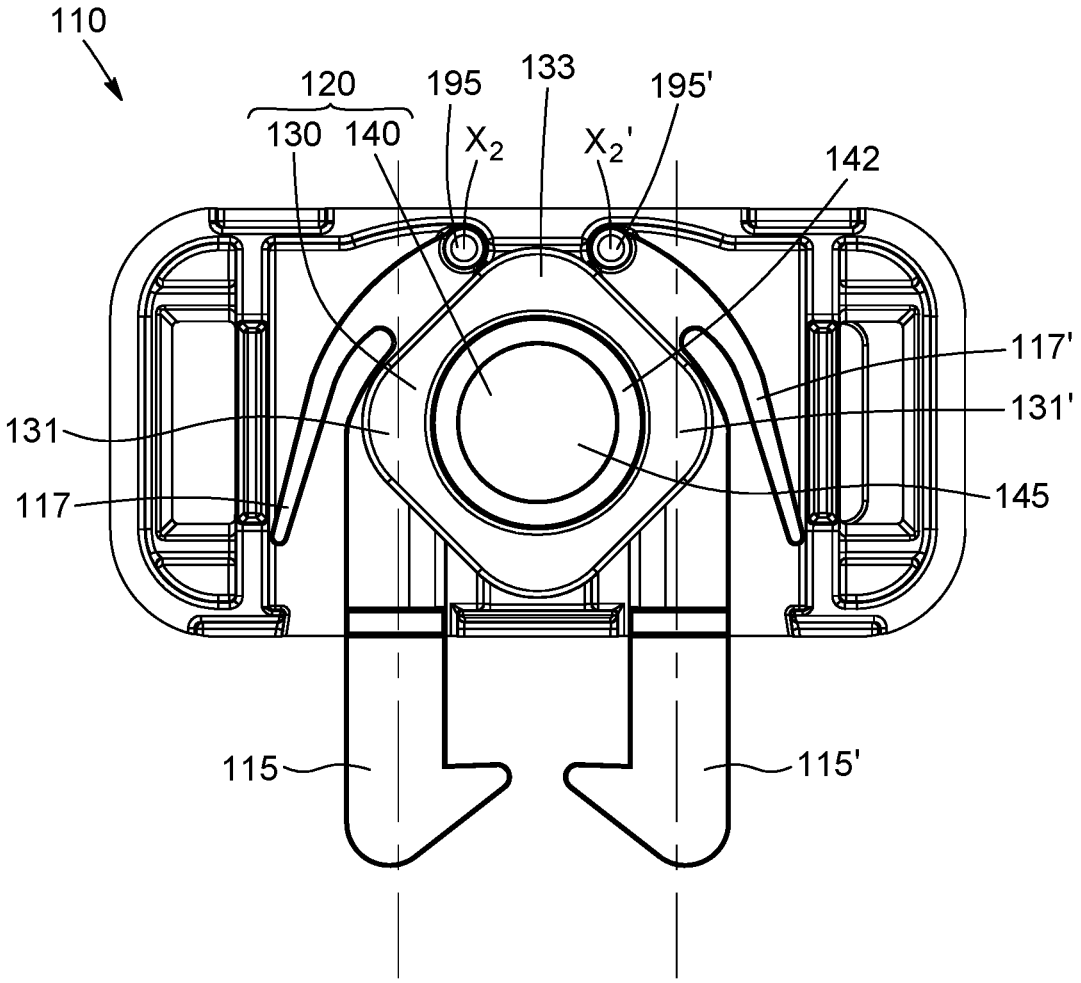
FIG. 14 is a top perspective view of the locking assembly of FIG. 10, a locking assembly cover of the locking assembly being removed.

The locking assembly 110 further comprises a function switch 170 that is translatable along a translation axis X3. In the shown embodiment, the translation axis X3 is substantially perpendicular to the unlocking axis X1. In the embodiment shown, the function switch 170 is slidable along an outer face 209 of the bottom wall 212 of the inner casing 109 (for instance between guiding rails 211 protruding from the outer face 209 of the inner casing 109, as represented in FIG. 9).

The function switch 170 comprises a pushbutton abutment 172 and is translatable along the translation axis X3 between a first configuration (or pushbutton-blocking configuration) in which the function switch 170 prevents the pushbutton 140 from being translated since the inner end 146 of the stem 144 abuts against the pushbutton abutment 172 of the function switch 170, and a second configuration (or pushbutton-displacement configuration) in which the pushbutton 140 is translatable in a direction substantially parallel to the unlocking axis X1, i.e. the pushbutton abutment 172 of the function switch 170 does not abut against the inner end 146 of the stem 144 and thus does not obstruct the translation of the pushbutton 140 along the direction substantially parallel to the unlocking axis X1.

It is to be noted that, due to the function switch 170 being located in the housing 102 of the dispenser 100, the function switch 170 is prevented from being displaced from the first configuration (or pushbutton-blocking configuration) to the second configuration (or pushbutton-displacement configuration) when the cover 108 and the base part 106 are configured in the closed configuration, i.e. access to the function switch 170 is prevented when the housing 102 of the dispenser 100 is configured in the closed configuration. Therefore, the function switch 170 can only be displaced from the first configuration to the second configuration (and vice-versa) (i.e. the locking assembly 110 can only change from the key-opening configuration to the pushbutton-opening configuration) when the base part 106 and the cover 108 of the housing 102 of the dispenser 100 are configured in the open configuration for the function switch 170 to be accessible. As will be described in more details later, the key 180 is required to unlock the housing 102 and configure same into the open configuration to provide access to the function switch 170, and then to allow changing the locking assembly 110 from the key-opening configuration to the pushbutton-opening configuration.

Moreover, the pushbutton abutment 172 of the function switch 170 is shaped and dimensioned to at least partially circumvent the unlocking end 134 (or inner end 134) of the unlocking body 130. In the embodiment shown, a longitudinal slot 135 (as represented in FIG. 9) is formed in the inner end 134 of the unlocking body 130 so that when the function switch 170 is configured in any of the first and second configurations (i.e. in any of the pushbutton-blocking configuration and the pushbutton-displacement configuration), the pushbutton abutment 172 (or any other part of the function switch 170) does not prevent the unlocking body 130 from being translated along the unlocking axis X1, as detailed below with reference to FIGS. 4A to 7B.

It is appreciated that the shape, the configuration, and the location of the function switch 170 with regards to the dispenser 100 can vary from the embodiment shown. For instance, the function switch 170 could be slidably mounted within the interior volume 105 of the inner casing 109.

Locking Assembly Operation

The different configurations of the first embodiment of the locking assembly 110 according to the present disclosure will now be described with reference to FIGS. 4A to 7B.

FIGS. 4A to 5B represent the first embodiment of the locking assembly 110 in the key-opening configuration.

When in the key-opening configuration, the function switch 170 is configured in the first configuration in which the function switch 170 prevents the pushbutton 140 from being displaced, i.e. translated towards the dispensing chamber 104. When in the key-opening configuration, the pushbutton abutment 172 of the function switch 170 prevents the pushbutton 140 from being translated in the interior volume 105 of the inner casing 109 along the unlocking axis X1.

Figure 4A:
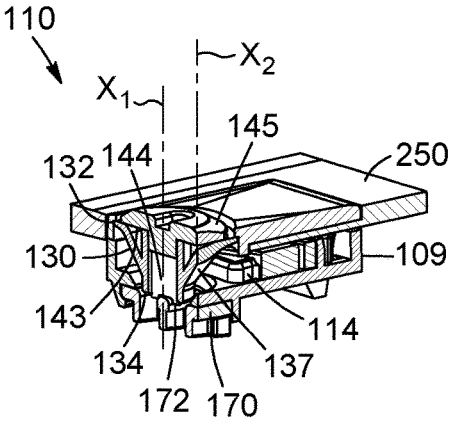
FIGS. 4A and 4B are respectively a perspective view, sectioned, and a cross-section view of the locking assembly of FIG. 3 configured in a key-opening configuration, without pressure being applied on an unlocking component of the locking assembly.
Figure 4B:
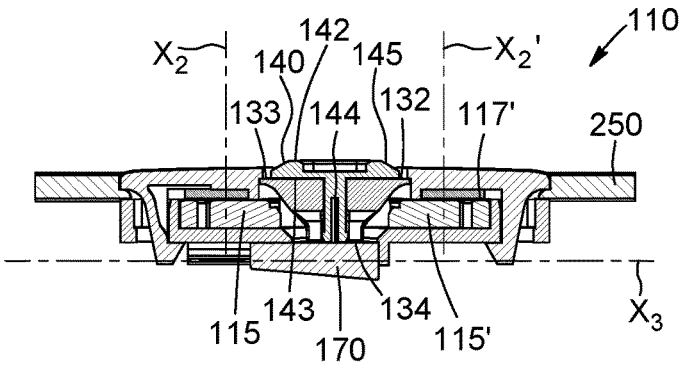

FIGS. 4A and 4B represent the locking assembly 110 in a static configuration, i.e. when no pressure is applied on the unlocking component 120. In the static configuration, the inner end 146 of the stem 144 abuts against the pushbutton abutment 172 of the function switch 170.

Figure 5A:
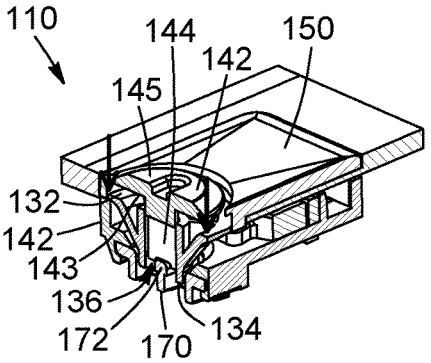
FIGS. 5A and 5B are respectively a perspective view, sectioned, and a cross-section view of the locking assembly of FIG. 3 configured in the key-opening configuration, wherein pressure is applied on an unlocking body of the unlocking component to configure the locking assembly into an unlocked configuration.
Figure 5B:
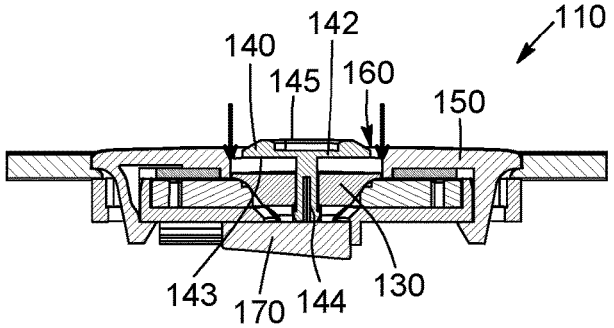

FIGS. 5A and 5B represent the locking assembly 110 when pressure is applied on the unlocking body 130 of the unlocking component 120. The pressure is represented by two vertical arrows.

More precisely, pressure is applied on the exposed portion 235 of the outer surface 133 of the unlocking body 130, i.e. the portion of the outer surface 133 that is not covered by the head 142 of the pushbutton 140. To this end, the above-mentioned key 180 can be used.

As shown in FIG. 17, in some implementations, the key 180 comprises a handling portion 182 and an opposed annular tip 184 with a peripheral wall 187 defining a recess 186. The peripheral wall 187 is dimensioned and shaped so that at least a portion of a distal end 188 of the peripheral wall 187 can be introduced in the peripheral groove 160 formed between the locking assembly cover 150, the head 142 of the pushbutton 140 and the actuation end 132 of the unlocking body 130. When the peripheral wall 187 is at least partially inserted into the peripheral groove 160, the head 142 of the pushbutton 140, which cannot translate due to the pushbutton abutment 172 of the function switch 170, is received into the recess 186. A pressure can thus be applied solely and directly on the outer surface 133 of the unlocking body 130 (more particularly on the exposed portion 235) by the distal end 188 of the peripheral wall 187 of the key 180.

Going back to FIGS. 5A and 5B with the locking assembly 110 being configured in the key-opening configuration, when a pressure is exerted on the unlocking body 130, the unlocking body 130 is translated along the unlocking axis X1, i.e. translated towards the dispensing chamber 104, whereas the pushbutton 140 is not displaced. The unlocking body 130 is thus displaced relatively to the stem 144 of the pushbutton 140, a gap being formed between the inner face 143 of the head 142 of the pushbutton 140 and the actuation end 132 of the unlocking body 130. The translation of the unlocking body 130 independently from the pushbutton 140 is made possible, in the embodiment shown, by the longitudinal slot 135 formed in the inner end 134 of the unlocking body 130, so that the inner end 134 does not abut against the pushbutton abutment 172 (or any other portion) of the function switch 170.

Due to the translation of the unlocking body 130 along the unlocking axis X1, the peripheral wall 137 of the unlocking body 130 further contacts/engages the first and second catch portions 115, 115'. Since the unlocking body 130 has a tapered shape, as the unlocking body 130 is further translated along the unlocking axis X1, the first and second catch portions 115, 115' are pivoted respectively about the first and second pivot axes X2, X2' towards the disengaged configuration, i.e. away from one another. The unlocking body 130 applies a force against the biasing force exerted by the first and second biasing members 117, 117' onto the first and second catch portions 115, 115' to pivot them into the disengaged configuration.

When the first and second catch portions 115, 115' are in the disengaged configuration, the lock catch 114 is disengaged from the catch-engaging portion 112. Therefore, the cover 108 and the base 106 can be moved relatively to each other into the open configuration.

FIGS. 6A to 7B represent the first embodiment of the locking assembly 110 in the pushbutton-opening configuration.

In the pushbutton-opening configuration, the function switch 170 is configured in the second configuration (or pushbutton-displacement configuration) wherein the pushbutton 140 is displaceable/translatable along a direction substantially parallel to the unlocking axis X1 (i.e. wherein the pushbutton 140 does not abut against the pushbutton abutment 172 of the function switch 170).

Figure 6A:
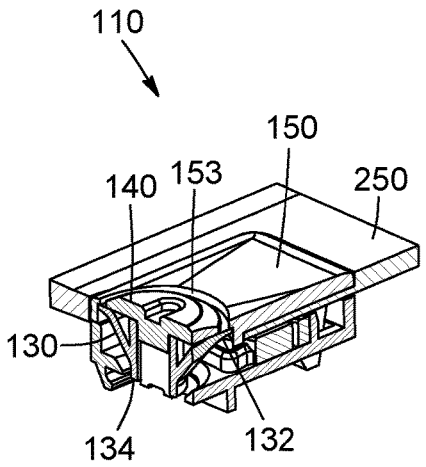
FIGS. 6A and 6B are respectively a perspective view, sectioned, and a cross-section view of the locking assembly of FIG. 3 configured in a pushbutton-opening configuration, without pressure being applied on the unlocking component.
Figure 6B:
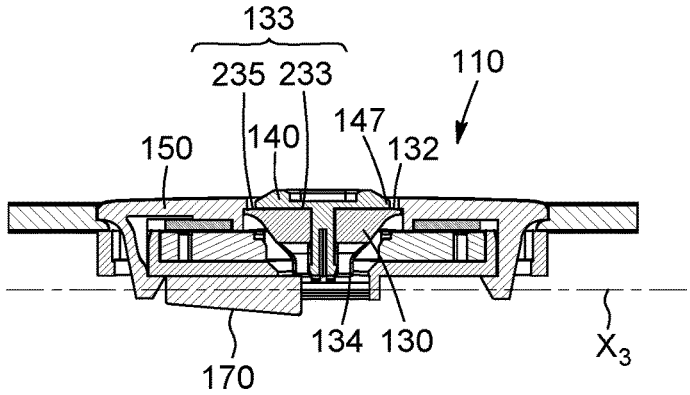

FIGS. 6A and 6B represent the locking assembly 110 in a static configuration, i.e. when no pressure is applied on the unlocking component 120. In the static configuration, the inner end 146 of the stem 144 does not abut against the pushbutton abutment 172 of the function switch 170 and can freely translate.

Figure 7A:
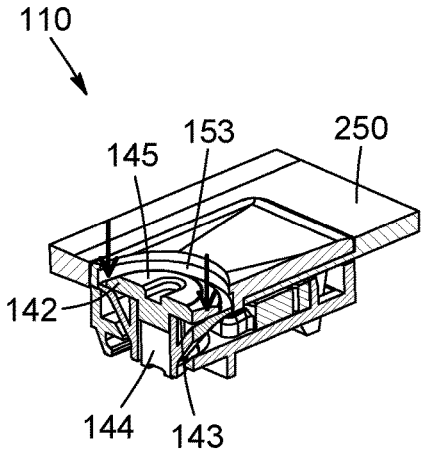
FIGS. 7A and 7B are respectively a perspective view, sectioned, and a cross-section view of the locking assembly of FIG. 3 configured in the pushbutton-opening configuration, wherein pressure is applied on the unlocking component to configure the locking assembly into the unlocked configuration.
Figure 7B:
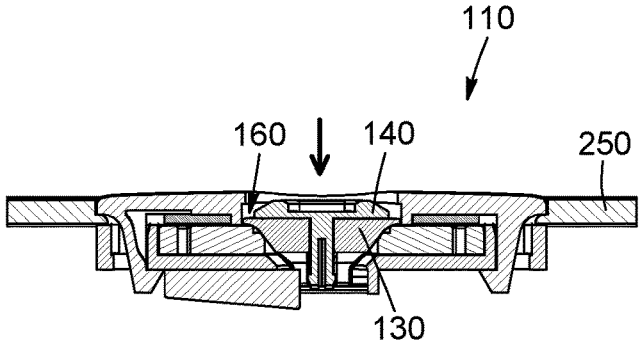

FIGS. 7A and 7B represent the locking assembly 110 when a pressure is applied on the outer face 145 of the head 142 of the pushbutton 140. The pressure is represented by two vertical arrows.

It is to be noted that no key is required to exert a pressure on the unlocking component 120 when the locking assembly 110 is configured in the pushbutton-opening configuration: the user can use his/her finger, or any adapted tool having a portion dimensioned to be introduced in the central opening 152 formed in the locking assembly cover 150.

When a pressure is exerted on the unlocking component 120, the locking assembly 110 being in the pushbutton-opening configuration, the unlocking body 130 and the pushbutton 140 are translated together along the unlocking axis X1. In a way similar to the above disclosed operation of the unlocking component 120 when the locking assembly 110 is configured in the key-opening configuration, the peripheral wall 137 of the unlocking body 130 then contacts/engages the first and second catch portions 115, 115' and pushes them apart. More particularly, the first and second catch portions 115, 115' are pivoted respectively about the first and second pivot axes X2, X2' into the disengaged configuration and against the biasing force exerted by the first and second springs 117, 117'.

As mentioned above, when the first and second catch portions 115, 115' are in the disengaged configuration, the lock catch 114 is disengaged from the catch-engaging portion 112. Therefore, the cover 108 and the base part 106 can be moved relatively to each other into the open configuration.

Second Embodiment of the Locking Assembly

A second embodiment of the locking assembly 110 is shown in FIGS. 10 to 16.

As in the first embodiment, the locking assembly 110 comprises an unlocking component 120 having an unlocking body 130 translatable to configure the locking assembly 110 into the unlocked configuration and a pushbutton 140 partially contained in the unlocking body 130. The pushbutton 140 is prevented from translation along a direction substantially parallel to the unlocking axis X1 when the locking assembly 110 is in the key-opening configuration.

The second embodiment of the locking assembly 110 mainly differentiates from the first embodiment in the shape of the unlocking body 130. As shown for instance in FIG. 13, the peripheral wall 137 of the unlocking body 130 is configured to contact the first and second catch portions 115, 115' of the lock catch 114 when the unlocking body 130 is displaced along the unlocking axis X1, so as to pivot the first and second catch portions 115, 115' about the first and second pivot axes X2, X2', to disengage the lock catch 114 from the catch-engaging portion 112. As shown in FIGS. 12 and 14 to 16, the peripheral wall 137 of the unlocking body 130 has a substantially square cross-section with a tapered profile. More particularly, the unlocking body 130 has two opposed first and second unlocking wall portions 131, 131' defining a diagonal of the substantially square cross-section of the peripheral wall 137, the first and second opposed unlocking wall portions 131, 131' having a tapered shape so that they contact/engage progressively the first and second catch portions 115, 115' so as to pivot the first and second catch portions 115, 115' into the disengaged configuration when the unlocking body 130 is translated along the unlocking axis X1.

Figure 15:
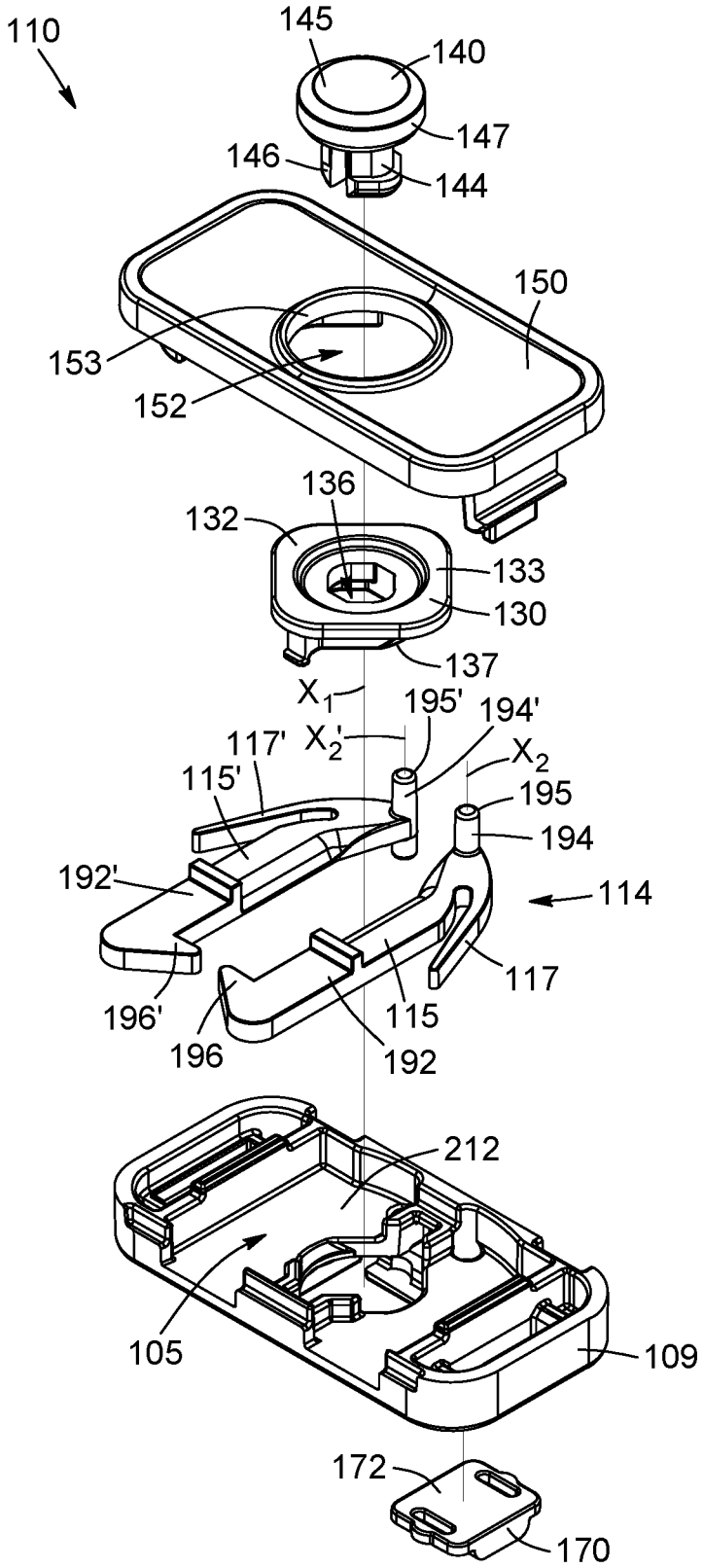
FIGS. 15 and 16 are top and bottom perspective views, exploded, of the locking assembly of FIG. 10.
Figure 16:
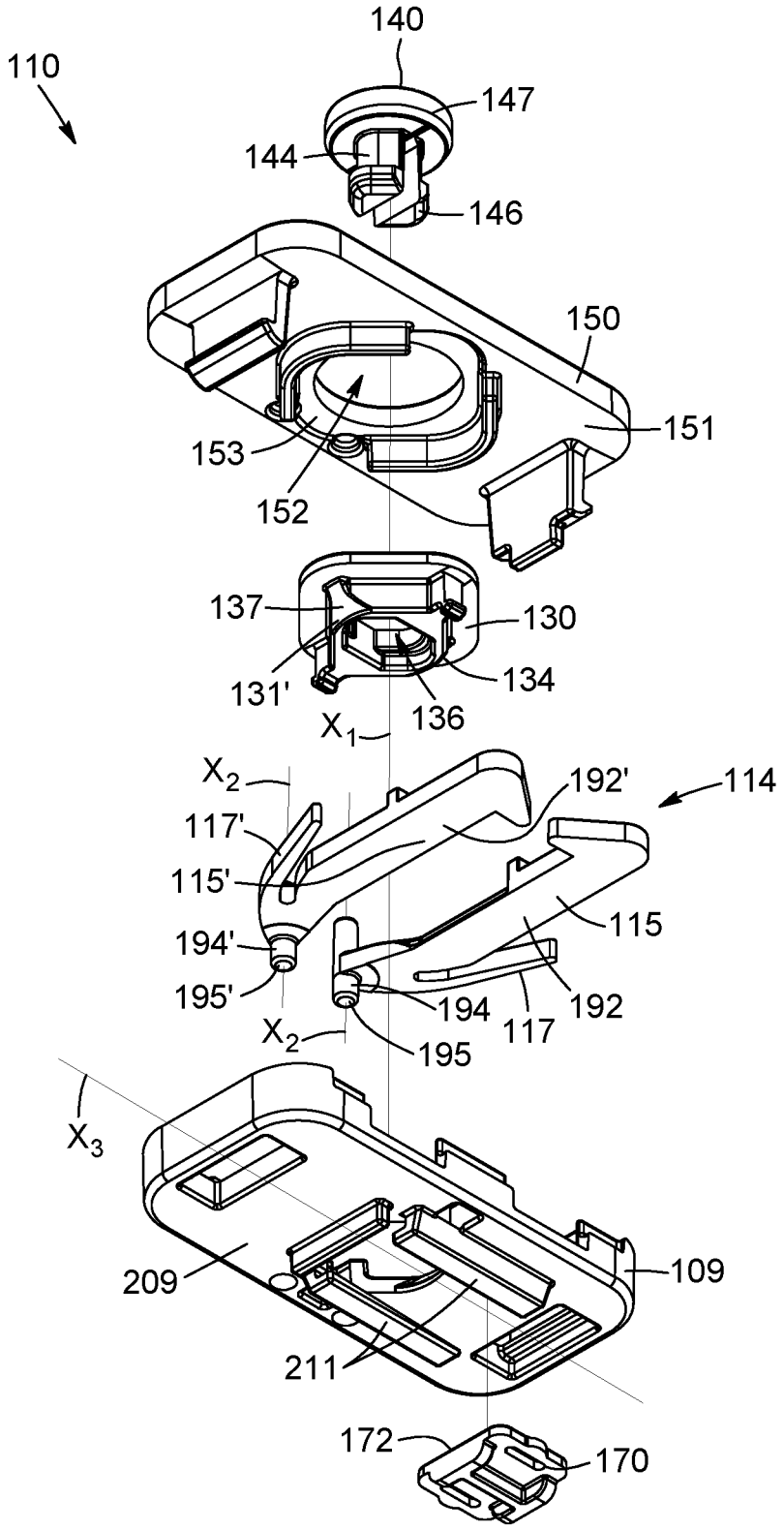

Apart from the shape of the unlocking 130, the second embodiment of the locking assembly 110 also differentiates from the first embodiment by the cooperation between the lock catch 114 and the locking casing 109 (or inner casing 109). In the second embodiment, as represented in FIGS. 15 and 16, pins 195, 195' protrude from the first ends 194, 194' of the catch portions 115, 115', that are receivable in openings formed in an inner surface 151 of the locking assembly cover 150, to pivotally mount the first and second catch portions 115, 115' in the inner casing 109. Moreover, in the second embodiment shown, the locking assembly cover 150 is directly mountable to the locking casing 109: to this end, without being limitative, mounting tabs protrude from the inner surface 151 of the locking assembly cover 150 which are receivable into openings formed in the inner casing 109.

Second Embodiment of the Key

It is to be noted that the locking assembly 110 is not limited to the disclosed embodiments. In particular, the shape, the configuration and the arrangement of the different components of the unlocking component 120 and/or any component of the locking assembly is not limited to the above described first and second embodiments.

For instance, the different components of the locking assembly 110 can be modified so that the peripheral groove 160 at least partially delimited by the exposed portion 235 of the actuation end 132 of the unlocking body 130, presents a different shape.

FIG. 18 represents another possible embodiment of the cooperation between the key 180 and the locking assembly 110. In the disclosed embodiment, a substantially square-shaped peripheral groove 160 is formed between the peripheral wall of the head 142 of the pushbutton 140, the inner edge 153 of the central opening 152 formed in the locking assembly cover 150 and the exposed portion 235 of the actuation end 132 of the unlocking body 130. The recess 186 that is formed in the distal end 188 of the key 180 and configured to cooperate with the peripheral groove 160 thus has a complementary substantially square-shaped cross-section.

It will be appreciated that the methods described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

What is claimed is:

1. A locking assembly mountable to a dispenser having a base part and a cover movable relative to each other between a closed configuration and an open configuration, the locking assembly being configured to lock the base part and the cover in the closed configuration when mounted to the dispenser, the locking assembly comprising:

an unlocking component mountable to a first element of the base part and the cover and comprising:

an unlocking body translatable to configure the locking assembly into an unlocked configuration; and a pushbutton at least partially contained in the unlocking body;

wherein the locking assembly is selectively configurable into:

a key-opening configuration wherein the pushbutton is prevented from translation and the unlocking body is displaceable relative to the pushbutton to configure the locking assembly into the unlocked configuration; and into a pushbutton-opening configuration wherein the unlocking body and the pushbutton are translatable together so that pressure on the pushbutton engages the unlocking body into translation to configure the locking assembly into the unlocked configuration.

2. The locking assembly according to claim 1, further comprising:

a catch-engaging portion mountable to a second element of the base part and the cover; and a lock catch mountable to said first element of the base part and the cover, the lock catch being configurable between an engaged configuration wherein the lock catch is engaged with said catch-engaging portion to maintain the base part and the cover in the closed configuration when the locking assembly is mounted to the dispenser, and a disengaged configuration wherein the lock catch is disengaged from the catch-engaging portion for the base part and the cover to be configurable in the open configuration when the locking assembly is mounted to the dispenser;

wherein the lock catch is configured into the disengaged configuration when the locking assembly is configured into the unlocked configuration.

3. The locking assembly according to claim 2, wherein the lock catch is pivotably mountable to said first element of the base part and the cover about a pivoting axis and wherein the unlocking body is translatable along an unlocking axis extending substantially parallel to the pivoting axis.

4. The locking assembly according to claim 3, wherein the unlocking body comprises a peripheral wall having a tapered shape and engaging with said lock catch when the unlocking body is translated along the unlocking axis and wherein the unlocking body further comprises an actuation end and an opposed unlocking end cooperating with said lock catch when the unlocking body is translated along the unlocking axis, the peripheral wall of the unlocking body being tapered towards the unlocking end.

5. The locking assembly according to claim 4, wherein a through opening is formed in the unlocking body, the pushbutton being at least partially slidably received in the through opening, and the pushbutton comprises a head protruding externally from the actuation end of the unlocking body, the actuation end of the unlocking body having an outer surface including a central portion covered by the head of the pushbutton and an exposed portion, surrounding the central portion.

6. The locking assembly according to claim 2, further comprising a biasing member operatively engaged with the lock catch and exerting a biasing force thereto to bias the lock catch into the engaged configuration.

7. The locking assembly according to claim 2, wherein the lock catch comprises first and second catch portions defining a gap therebetween, the unlocking body being translatable into said gap.

8. The locking assembly according to claim 1, further comprising a locking casing mountable to said first element of the base part and the cover and defining an interior volume containing at least partially the unlocking component.

9. The locking assembly according to claim 1, further comprising a function switch movable between a pushbutton-blocking configuration in which the function switch prevents the pushbutton from being translated, and a pushbutton displacement configuration in which the pushbutton is translatable.

10. The locking assembly according to claim 9, wherein the function switch comprises a pushbutton abutment, the pushbutton abutting against the pushbutton abutment when the function switch is configured in the pushbutton-blocking configuration.

11. The locking assembly according to claim 9, the unlocking body comprising an actuation end and an opposed unlocking end, wherein the pushbutton abutment circumvents the unlocking end of the unlocking body, when the function switch is configured in the pushbutton-blocking configuration.

12. The locking assembly according to claim 1, further comprising a key having a distal end with a peripheral wall defining a recess to receive a portion of the pushbutton.

13. A web material dispenser comprising:

a housing defining a dispensing chamber and having a base part and a cover movable relative to each other between a closed configuration in which said dispensing chamber is at least partially closed, and an open configuration for providing access to said dispensing chamber; and a locking assembly according to claim 1 to lock the base part and the cover in the closed configuration, the unlocking component being mounted to first element of the base part and the cover.

14. A dispenser comprising:

a housing defining a dispensing chamber and having a base part and a cover movable relative to each other between a closed configuration in which said dispensing chamber is at least partially closed, and an open configuration for providing access to said dispensing chamber; and a locking assembly mounted to first element of the base part and the cover to lock the base part and the cover in the closed configuration, the locking assembly comprising an unlocking component including:

an unlocking body translatable to configure the locking assembly into an unlocked configuration, and a pushbutton at least partially contained in the unlocking body, wherein the locking assembly is selectively configurable into:

a key-opening configuration wherein the pushbutton is prevented from translation and the unlocking body is displaceable relative to the pushbutton to configure the locking assembly into the unlocked configuration; and into a pushbutton-opening configuration wherein the unlocking body and the pushbutton are translatable together so that pressure on the pushbutton engages the unlocking body into translation to configure the locking assembly into the unlocked configuration.

15. The dispenser according to claim 14, further comprising:

a catch-engaging portion mounted to a second element of the base part and the cover; and a lock catch mounted to said first element of the base part and the cover, the lock catch being configurable between an engaged configuration wherein the lock catch is engaged with said catch-engaging portion to maintain the base part and the cover in the closed configuration, and a disengaged configuration wherein the lock catch is disengaged from the catch-engaging portion for the base part and the cover to be configurable in the open configuration;

wherein the lock catch is configured into the disengaged configuration when the locking assembly is configured into the unlocked configuration.

16. The dispenser according to claim 15, wherein the lock catch is pivotably mounted to said first element of the base part and the cover about a pivoting axis and wherein the unlocking body is translatable along an unlocking axis extending substantially parallel to the pivoting axis.

17. The dispenser according to claim 16, wherein the unlocking body comprises a peripheral wall having a tapered shape and cooperating with said lock catch when the unlocking body is translated along the unlocking axis, and wherein the unlocking body further comprises an actuation end and an opposed unlocking end cooperating with said lock catch when the unlocking body is translated along the unlocking axis, the peripheral wall of the unlocking body being tapered towards the unlocking end.

18. The dispenser according to claim 17, wherein a through opening is formed in the unlocking body, the pushbutton being at least partially slidably received in the through opening, and the pushbutton comprises a head protruding externally from the actuation end of the unlocking body, the actuation end of the unlocking body having an outer surface including a central portion covered by the head of the pushbutton and an exposed portion, surrounding the central portion.

19. The dispenser according to claim 18, further comprising:

a locking casing mounted to said first element of the base part and the cover and defining an interior volume containing at least partially the unlocking component; and a locking assembly cover partially closing the interior volume of the locking casing.

20. The dispenser according to claim 19, wherein an opening is formed in the locking assembly cover, the locking assembly cover comprising an inner rim bordering the opening, a peripheral groove being defined between the inner rim of the locking assembly cover, a peripheral wall of the head of the pushbutton and the exposed portion of the unlocking body; and wherein the locking assembly further comprises a key having a distal end with a peripheral wall defining a recess to receive a portion of the pushbutton when the peripheral wall is at least partially inserted into the peripheral groove.

21. The dispenser according to claim 15, further comprising a biasing member operatively engaged with the lock catch and exerting a biasing force thereto to bias the lock catch into the engaged configuration; and wherein the lock catch comprises first and second catch portions defining a gap therebetween, the unlocking body being translatable into said gap.

22. The dispenser according to claim 15, further comprising a function switch movable between a pushbutton-blocking configuration in which the function switch prevents the pushbutton from being translated, and a pushbutton displacement configuration in which the pushbutton is translatable; and wherein the function switch comprises a pushbutton abutment, the pushbutton abutting against the pushbutton abutment when the function switch is configured in the pushbutton-blocking configuration.

23. The dispenser according to claim 22, wherein the unlocking body comprises an actuation end and an opposed unlocking end, wherein the pushbutton abutment circumvents the unlocking end of the unlocking body, when the function switch is configured in the pushbutton-blocking configuration.

24. The dispenser according to claim 22, wherein the unlocking body is translatable along an unlocking axis and the function switch is slidably mounted to said first element of the base part and the cover along a first direction substantially perpendicular to the unlocking axis.

25. The dispenser according to claim 22, wherein the function switch is accessible only when the cover and the base part are in the open configuration.

* * * * *